US006495501B1

(12) United States Patent
Del Duca et al.

(10) Patent No.: US 6,495,501 B1
(45) Date of Patent: Dec. 17, 2002

(54) LAUNDRY BLEACHING COMPOSITIONS

(75) Inventors: Valerio Del Duca, Massalubrense (IT); Stefano Giunti, Fermignano (IT); Roberto Scaramella, Rome (IT)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/554,207

(22) PCT Filed: Nov. 9, 1998

(86) PCT No.: PCT/US98/23772

§ 371 (c)(1), (2), (4) Date: Jun. 19, 2000

(87) PCT Pub. No.: WO99/24540

PCT Pub. Date: May 20, 1999

(51) Int. Cl.[7] ..... C11D 3/00; C11D 7/18; C11D 7/54; C11D 17/04; D06L 17/04

(52) U.S. Cl. ..... 510/283; 510/372; 510/284

(58) Field of Search ..... 510/293, 372, 510/283, 284

(56) References Cited

U.S. PATENT DOCUMENTS

| | | | | | |
|---|---|---|---|---|---|
| 3,852,210 | A | * | 12/1974 | Krezanoski | 252/95 |
| 4,166,794 | A | * | 9/1979 | Grey | 252/8.8 |
| 4,430,236 | A | * | 2/1984 | Franks | 252/95 |
| 4,900,468 | A | * | 2/1990 | Mitchell et al. | 252/95 |
| 4,900,469 | A | * | 2/1990 | Farr et al. | 252/96 |

* cited by examiner

*Primary Examiner*—Yogendra N Gupta
*Assistant Examiner*—John M Petruncio
(74) *Attorney, Agent, or Firm*—James F. McBride; Richard S. Echler, Sr.; Kim W. Zerby

(57) ABSTRACT

The present invention relates to a liquid composition suitable for bleaching and pretreating soiled fabrics. Such composition provides cleaning and color safety benefits that are especially noticeable when such composition is used as a prespotter. The present invention also relates to methods of using such composition to bleach or pretreat fabrics.

41 Claims, No Drawings

LAUNDRY BLEACHING COMPOSITIONS

TECHNICAL FIELD

The present invention relates to the bleaching of soiled fabrics and to compositions suitable to be used as laundry detergent and especially as laundry pretreater.

BACKGROUND

Peroxygen bleach-containing compositions have been extensively described in laundry applications as laundry detergents, laundry additives or even laundry pretreaters.

Indeed, it is known to use liquid peroxygen bleach-containing compositions having an acidic to neutral pH (typically up to 7, preferably from 1 to 6, and more preferably around 5) in laundry treatment applications to boost the removal of encrustated stains/soils which are otherwise particularly difficult to remove, such as grease, coffee, tea, grass, mud/clay-containing soils and the like. However, we have found that a drawback associated with such peroxygen bleach-containing compositions is that these compositions may damage fabric colors, especially when used in a pretreatment application, i.e., when applied directly (neat) onto the fabrics, and left to act onto the fabrics for prolonged periods of time before rinsing the fabrics, or before washing the fabrics and subsequently rinsing them.

It is thus an object of the present invention to provide improved color safety to fabrics upon bleaching, especially in pretreatment applications where the compositions are left neat into contact with the fabrics for prolonged periods of time before rinsing them or washing them and subsequently rinsing them.

Indeed, when pretreating a fabric with a composition comprising a peroxygen bleach like hydrogen peroxide formulated at a pH up to 7, the composition applied neat on the fabric and left to act on it before being rinsed off has the tendency to evaporate on the fabric. It has been observed that upon evaporation of such peroxygen bleach-containing compositions the water contained in such compositions evaporates faster than the peroxygen bleach. In other words, the water evaporation contributes to increase the concentration of peroxygen bleach in the liquid composition that has been poured onto the surface of the fabric. This much higher concentration accelerates the production of free radicals and, as a consequence, the damage of the fabric and of its colours. It is also speculated that an auto-oxidation reaction occurs upon evaporation of water when the liquid compositions are left to dry onto the fabrics. This reaction of auto-oxidation generates peroxy-radicals which may contribute to the degradation of cellulose and of certain dyes present in the fabrics resulting thereby in chemical damage of dye molecules which is visible as discoloration and/or hue change. Thus, it is highly recommended in usage instructions of such commercially available peroxygen bleach-containing compositions to not leave the liquid bleaching compositions to dry onto the fabrics, in a process of pretreating soiled fabrics therewith.

More surprisingly, it has now been observed that this evaporation process also results in a pH drop on top of an increase in bleaching agent concentration. It is speculated that the pH drop to strong acidic values, typically below pH 2, accelerates the color damage when pretreating a coloured fabric.

It has now been found that improved color safety can be achieved by formulating a liquid bleaching composition having a pH up to 7 and comprising a peroxygen bleach, from 0.1% to 10% by weight of the total composition of a pH buffering means and from 0.0001% to 5% by weight of a perfume. More particularly, it has been found that the use, in a peroxygen bleach-containing composition having a pH up to 7, of a pH buffering means, for pretreating a soiled coloured fabric, considerably reduces the color damage on the fabric pretreated with such a composition.

Avantageously, the compositions according to the present invention also provides effective fabric safety on top of the effective color safety.

Another advantage of the present invention is that excellent bleaching performance on a broad range of stains and soils such as bleachable stains and/or greasy stains is also provided.

Another advantage of the present invention is that the compositions according to the present invention provide excellent performance not only when used in a pretreatment laundry application but also when used in any laundry applications, for instance when used as a laundry detergent or a laundry additive, or even in other applications like in hard surface cleaning applications.

Yet another advantage is that the compositions herein are physically and chemically stable upon prolonged periods of storage.

In a preferred embodiment, the compositions according to the present invention further comprise a surfactant or a mixture thereof, for example a zwitterionic betaine surfactant together with an alkoxylated nonionic surfactant. Indeed, it has been found that such a surfactant system further boosts the bleaching performance and contributes to effective stain removal performance on various types of stains including greasy stains like mayonnaise, vegetable oil, sebum, make-up, and the like of the compositions herein. In a highly preferred embodiment herein the compositions of the present invention comprise a salt free zwitterionic betaine surfactant. Indeed, using such salt free zwitterionic betaine surfactants instead of conventional zwitterionic betaine surfactants further contributes to the benefits of the present compositions, i.e., improved color and fabric safety.

SUMMARY OF THE INVENTION

The present invention encompasses a liquid composition suitable for pretreating fabrics having a pH up to 7 and comprising a peroxygen bleach, from 0.1% to 10% by weight of the total composition of a pH buffering means, and from 0.0001% to 5% by weight of a perfume.

The present invention further encompasses processes of bleaching fabrics, starting from a liquid composition as defined herein. The processes include the steps of contacting said fabrics with the liquid bleaching composition neat or diluted, and subsequently rinsing said fabrics. In the preferred embodiment, when the fabrics are "pretreated", the composition is applied neat on the fabrics, and the fabrics are rinsed, or washed in a normal wash cycle and subsequently rinsed with water.

DETAILED DESCRIPTION OF THE INVENTION

The Liquid Compositions

The compositions according to the present invention are liquid compositions as opposed to a solid or a gas. As used herein "liquid" includes "pasty" compositions. The liquid compositions herein are preferably aqueous compositions. The liquid compositions according to the present invention preferably have a pH up to 7, more preferably from 1 to 6, and even more preferably from 1.5 to 5.5. Formulating the compositions according to the present invention in the acidic pH range contributes to the chemical stability of the compositions and to the stain removal performance of the compositions.

Peroxygen Bleach

As an essential element the compositions according to the present invention comprise a peroxygen bleach or a mixture thereof. Indeed, the presence of peroxygen bleach provides excellent bleaching and cleaning benefits. Suitable peroxygen bleaches to be used herein are hydrogen peroxide, water soluble sources thereof, or mixtures thereof. As used herein a hydrogen peroxide source refers to any compound which produces perhydroxyl ions when said compound is in contact with water.

Suitable water-soluble sources of hydrogen peroxide for use herein include percarbonates, persilicates, perborates, peroxyacids such as diperoxydodecandioic acid (DPDA), magnesium perphtalic acid, perlauric acid, perbenzoic and alkylperbenzoic acids, hydroperoxides, aliphatic and aromatic diacyl peroxides, and mixtures thereof. Preferred peroxygen bleaches herein are hydrogen peroxide, hydroperoxide and/or diacyl peroxide. Hydrogen peroxide is the most preferred peroxygen bleach herein.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide. Such hydroperoxides have the advantage to be particularly safe to fabrics and color while delivering excellent bleaching performance.

Suitable aliphatic diacyl peroxides for use herein are dilauroyl peroxide, didecanoyl peroxide, dimyristoyl peroxide, or mixtures thereof. Suitable aromatic diacyl peroxide for use herein is for example benzoyl peroxide. Such diacyl peroxides have the advantage to be particularly safe to fabrics and color while delivering excellent bleaching performance.

Typically, the compositions herein comprise from 0.1% to 20% by weight of the total composition of said peroxygen bleach or mixtures thereof, preferably from 1% to 15% and most preferably from 2% to 10%.

The pH Buffering Means

As an essential element the compositions according to the present invention comprise a pH buffering means or a mixture thereof at a level of from 0.1% to 10% by weight of the total composition. Preferably, the compositions herein comprise from 0.2% to 8% by weight of the total composition of a pH buffering means or a mixture thereof, preferably from 0.3% to 5%, more preferably from 0.3% to 3% and most preferably from 0.3% to 2%.

By "pH buffering means", it is meant herein any compound which when added to a solution makes the solution to resist to a change in hydrogen ion concentration on addition of acid or alkali.

Preferred pH buffering means for use herein comprise a weak acid having its pKa (if only one) or at least one of its pkas in the range from 1.5 to 6.5, preferably from 2 to 6 and more preferably from 4 to 6, and its conjugated base.

pka is defined according to the following equation:

$$pK_a = -\log K_a$$

where $K_a$ is the Dissociation Constant of the weak acid in water and corresponds to the following equation:

$$[A^-][H^+]/[HA] = K_a$$

where HA is the acid and $A^-$ is the conjugated base.

By "conjugated base", it is meant herein the corresponding base ($A^-$) of the weak acid herein (HA). This conjugate base may be obtained by adding a source of alkalinity into the compositions according to the present invention comprising a weak acid as defined herein. Suitable source of alkalinity suitable for use herein are the caustic alkalis such as sodium hydroxide, potassium hydroxide and/or lithium hydroxide and/or the alkali metal oxides such as sodium and/or potassium oxide. A preferred source of alkalinity is a caustic alkali, more preferably sodium hydroxide and/or potassium hydroxide. Alternatively the conjugate base may be commercially available perse and added directly to the weak acid herein.

Typically, according to the present invention the weak acid (HA) and its conjugate base ($A^-$) are in equilibrium in the compositions of the present according to the equation:

$$HA \leftrightarrows A^- + H^+ \text{(hydrogen ions)}$$

Preferably the pH buffering means herein consists of the weak acid as defined herein and its conjugate base at a weight ratio of the weak acid to its conjugate base of preferably 0.1:1 to 10:1, more preferably 0.2:1 to 5:1. Highly preferred ratio of the weak acid to its conjugate base is 1 since this is the best combination to achieve optimum buffering capacity.

Preferably a given pH buffering means herein will be used to buffer compositions having a pH between pH=pKa−1 and pH=pKa+1 of each of its pKa. For example citric acid/citrate is particularly suitable to buffer compositions having a pH comprised between 3.74 and 5.74 (pKa 2=4.74) and between 2.06 and 4.06 (pKa 1=3.06).

Suitable weak acids having at least one of their pKa's of from 1.5 to 6 for use herein include citric acid (pKa 1=3.06, pKa 2=4.74), oxalic acid (pKa 2=4.19), tartaric acid (pKa 1=2.99, pKa 2=4.34), phtalic acid (pKa 1=2.89, pKa 2=5.41), acetic acid (pKa=4.74), benzoic acid (pKa=4.20), formic acid (pKa=3.76) and salicylic acid (pKa 1=2.97).

Particularly suitable pH buffering means for use herein are citric acid/sodium citrate, citric acid/potassium citrate, oxalic acid/sodium oxalate, tartaric acid/potassium hydrogen tartarate, oxalic acid/potassium tetra oxalate dihydrate, phtalic acid/potassium phtalate, acetic acid/sodium acetate, formic acid/sodium formate, benzoic acid/sodium benzoate, and/or salicylic acid/sodium salicylate. Preferred pH buffering means for use herein are citric acid/sodium citrate, citric acid/potassium citrate, oxalic acid/sodium oxalate, tartaric acid/potassium hydrogen tartarate, oxalic acid/potassium tetra oxalate dihydrate, and most preferred is citric acid/sodium citrate and/or citric acid/potassium citrate.

Highly preferred pH buffering means for use herein is citric acid and sodium citrate.

Citric acid is commercially available from Sigma Aldrich and from Flucka Chemicals under its chemical name.

The Perfume

As an essential element the compositions according to the present invention comprise a perfume or a mixture thereof at a level of from 0.0001% to 5% by weight of the total composition. Preferably, the compositions herein comprise from 0.0001% to 1% by weight of the total composition of a perfume or a mixture thereof, more preferably from 0.001% to 1%, and most preferably from 0.01% to 0.5%.

Naturally, for the purpose of the present invention the perfumes for use herein are stable to peroxygen bleach.

By "stable" to peroxygen bleach, it is meant herein a perfume which shows odor stability after 10 days of storage at 50° C. and which does not affect the product stability.

Suitable perfumes for use herein include materials which provide an olfactory aesthetic benefit and/or help to cover any "chemical" odour that the product may have. The main function of a small fraction of the highly volatile, low boiling (having low boiling points), perfume components in these perfumes is to improve the fragrance odour of the product itself, rather than impacting on the subsequent odour of the surface being cleaned. However, some of the less volatile, high boiling perfume ingredients provide a fresh and clean impression to the surfaces, and it is desirable that these ingredients be deposited and present on the dry surface. Perfume ingredients can be readily solubilized in the compositions, for instance by the nonionic detergent surfactants. The perfume ingredients and compositions suitable to be used herein are the conventional ones known in the art. Selection of any perfume component, or amount of perfume, is mainly based on aesthetic considerations.

Suitable perfume compounds and compositions can be found in the art including U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference. In general, the degree of substantively of a perfume is roughly proportional to the percentages of substantive perfume material used. Relatively substantive perfumes contain at least about 1%, preferably at least about 10%, substantive perfume materials. Substantive perfume materials are those odorous compounds that deposit on surfaces via the cleaning process and are detectable by people with normal olfactory acuity. Such materials typically have vapour pressures lower than that of the average perfume material. Also, they typically have molecular weights of about 200 and above, and are detectable at levels below those of the average perfume material. Perfume ingredients useful herein, along with their odour character, and their physical and chemical properties, such as boiling point and molecular weight, are given in "Perfume and Flavour Chemicals (Aroma Chemicals)," Steffen Arctander, published by the author, 1969, incorporated herein by reference.

Examples of the highly volatile, low boiling, perfume ingredients are anethole, benzyl acetate, benzyl alcohol, iso-bornyl acetate, camphene, citronellol, citronellyl acetate, para-cymene, dihydrolinalool, dihydromyrcenol, dimethyl phenyl carbinol, eucaliptol, geraniol, geranyl acetate, geranyl nitrile, cis-3-hexenyl acetate, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, mycrene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components linalool; linalyl acetate; geraniol; and citronellol. Lemon oil and orange terpenes both contain about 95% of d-limonene.

Examples of moderately volatile perfume ingredients are amyl cinnamic aldehyde, iso-amyl salicylate, beta-caryophyllene, cedrene, cinnamic alcohol, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, triethyl citrate, vanillin, and veratraldehyde. Cedarwood terpenes are composed mainly of alpha-cedrene, beta-cedrene, and other C15H24 sesquiterpenes.

Examples of the less volatile, high boiling, perfume ingredients are benzophenone, benzyl salicylate, ethylene brassylate, hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone and phenylethyl phenyl acetate.

Selection of any particular perfume ingredient is primarily dictated by aesthetic considerations.

The present invention is based on the finding that the pH buffering means reduces the pH drop otherwise occuring when a peroxygen bleach containing composition having a pH up to 7 is applied neat onto the fabrics to preated and left to act (and thus evaporate) before rinsing off the fabrics, or washing the fabrics and subsequently rinsing off the fabrics. In other words, the color damage of some kinds of dyes (e.g. blue and/or green dyes especially found on coloured fabrics made of silks), i.e., the color change and/or decoloration, observed when bleaching such soiled coloured fabrics with a peroxygen bleach-containing composition having a pH up to 7 and a pH buffering means, is reduced, as compared to the color change and/or decoloration observed when using the same composition but without any pH buffering means. This color change and/or decoloration reduction is observed especially in a pretreatment application where the composition is left to dry or only partially dry onto the soiled coloured fabrics (this means left to dry typically for a period of time ranging from 5 to 60 minutes).

The colour damage of a coloured fabric may be evaluated by visual grading and/or by an instrumental method with the HunterLab Tristimulus MINISCAN® by comparing side by side coloured fabrics bleached according to the present invention and coloured fabrics bleached with a reference composition being for example free of any pH buffering means.

Advantageously, the tensile strength loss caused by the presence of copper and/or iron and/or manganese and/or chromium on the fabric surface and/or by the exposure to UV radiation from sunlight is also reduced when bleaching and especially when pretreating a soiled fabric with the compositions according to the present invention.

The tensile strength loss of a fabric may be measured by employing the Tensile Strength method. This method consists in measuring the tensile strength of a given fabric by stretching said fabric until it breakes. The force, expressed in Kg, necessary to break the fabric is the "Ultimate Tensile Stress" and may be measured with a Stress-Strain INSTRON® Machine available from INSTRON. The loss of tensile strength is the difference between the tensile strength of a fabric taken as a reference, i.e. a fabric which has not been bleached, and the tensile strength of the same fabric after having been bleached. A tensile strength loss of zero means that no fabric damage is observed.

Also fabric tensile strength loss reduction and/or color damage reduction are obtained according to the present invention, without compromising on the bleaching performance nor on the stain removal performance.

Also an advantage of the compositions of the present invention is that they are physically and chemically stable upon prolonged periods of storage. More particularly, the pH buffering means, in the compositions according to the present invention, contribute to the excellent chemical stability of said compositions upon prolonged storage periods. More particularly a secondary benefit of the pH buffering means especially citric acid/citrate, used in the compositions herein is that they act as an antioxidant, i.e. they absorb oxygen present in the bleaching environment and thus reduce the oxidation decomposition of the oxidable ingredients present in the bleaching compositions, namely the peroxygen bleaches, perfumes, dyes and the like.

Chemical stability of the compositions herein may be evaluated by measuring the concentration of available oxygen (often abbreviated to AvO2) at given storage time after having manufactured the compositions. The concentration of available oxygen can be measured by chemical titration methods known in the art, such as the iodometric method, thiosulphatimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

By "physically stable", it is meant herein that no phase separation occurs in the compositions for a period of 14 days at 50° C.

Optional Ingredients

The compositions herein may further comprise a variety of other optional ingredients such as surfactants, chelating agents, radical scavengers, antioxidants, builders, stabilisers, bleach activators, soil suspenders, soil suspending polyamine polymers, polymeric soil release agents, catalysts, dye transfer agents, solvents, brighteners, perfumes, pigments and dyes.

The Surfactant

The compositions according to the present invention may comprise a surfactant or a mixture thereof as a highly preferred optional ingredient. Naturally, for the purpose of the present invention the surfactants are stable to the peroxygen bleach.

Typically, the compositions of the present invention comprise up to 60% by weight of the total composition of a surfactant or a mixture thereof, preferably from 0.1% to 30%, more preferably from 0.5% to 15% and most preferably from 1% to 10%.

Suitable surfactants for use herein include any nonionic, anionic, zwitterionic, cationic and/or amphoteric surfactants.

Particularly suitable surfactants for use herein are nonionic surfactants such as alkoxylated nonionic surfactants and/or polyhydroxy fatty acid amide surfactants and/or amine oxides and/or zwitterionic surfactants like the zwitterionic betaine surfactants described herein after.

Suitable alkoxylated nonionic surfactants for use herein are ethoxylated nonionic surfactants according to the formula $RO—(C_2H_4O)_nH$, wherein R is a $C_6$ to $C_{22}$ alkyl chain or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains. Propoxylated nonionic surfactants and ethoxy/propoxylated ones may also be used herein instead of the ethoxylated nonionic surfactants as defined herein above or together with said surfactants.

Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol® 91-2.5 (HLB=8.1; R is a mixture of C9 and $C_{11}$ alkyl chains, n is 2.5), or Lutensol® TO3 (HLB=8; R is a $C_{13}$ alkyl chains, n is 3), or Lutensol)® AO3 (HLB=8; R is a mixture of $C_{13}$ and $C_{15}$ alkyl chains, n is 3), or Tergitol® 25L3 (HLB=7.7; R is in the range of $C_{12}$ to $C_{15}$ alkyl chain length, n is 3), or Dobanol® 23-3 (HLB=8.1; R is a mixture of $C_{12}$ and $C_{13}$ alkyl chains, n is 3), or Dobanol® 23-2 (HLB=6.2; R is a mixture of $C_{12}$ and $C_{13}$ alkyl chains, n is 2), or Dobanol® 45-7 (HLB=11.6; R is a mixture of $C_{14}$ and $C_{15}$ alkyl chains, n is 7) Dobanol® 23-6.5 (HLB=11.9; R is a mixture of $C_{12}$ and $C_{13}$ alkyl chains, n is 6.5), or Dobanol® 25-7 (HLB=12; R is a mixture of $C_{12}$ and $C_{15}$ alkyl chains, n is 7), or Dobanol® 91-5 (HLB=11.6; R is a mixture of $C_9$ and $C_{11}$ alkyl chains, n is 5), or Dobanol® 91-6 (HLB=12.5; R is a mixture of $C_9$ and $C_{11}$ alkyl chains, n is 6), or Dobanol® 91-8 (HLB=13.7; R is a mixture of $C_9$ and $C_{11}$ alkyl chains, n is 8), Dobanol® 91-10 (HLB=14.2; R is a mixture of $C_9$ to $C_{11}$ alkyl chains, n is 10), or mixtures thereof. Preferred herein are Dobanol® 91-2.5, or Lutensol® TO3, or Lutensol® AO3, or Tergitol® 25L3, or Dobanol® 23-3, or Dobanol® 23-2, or mixtures thereof. These Dobanol® surfactants are commercially available from SHELL. These Lutensol® surfactants are commercially available from BASF and these Tergitol® surfactants are commercially available from UNION CARBIDE.

Suitable chemical processes for preparing the alkoxylated nonionic surfactants for use herein include condensation of corresponding alcohols with alkylene oxide, in the desired proportions. Such processes are well-known to the man skilled in the art and have been extensively described in the art.

The compositions herein may desirably comprise one of those ethoxylated nonionic surfactants or a mixture of those ethoxylated nonionic surfactants having different HLBs (hydrophilic-lipophilic balance). In a preferred embodiment, the compositions herein comprise an ethoxylated nonionic surfactant according to the above formula and having an HLB up to 10 (i.e., a so called hydrophobic ethoxylated nonionic surfactant), preferably below 10, more preferably below 9, and an ethoxylated nonionic surfactant according to the above formula and having an HLB above 10 to 16 (i.e., a so called hydrophilic ethoxylated nonionic surfactant), preferably from 11 to 14. Indeed, in this preferred embodiment the compositions of the present invention typically comprise from 0.01% to 15% by weight of the total composition of said hydrophobic ethoxylated nonionic surfactant, preferably from 0.5% to 10% and from 0.01% to 15% by weight of said hydrophilic ethoxylated nonionic surfactant, preferably from 0.5% to 10%. Such mixtures of ethoxylated nonionic surfactants with different HLBs may be desired as they allow optimum grease cleaning removal performance on a broader range of greasy soils having different hydrophobic/hydrophilic characters.

Other particularly suitable nonionic surfactants for use herein include polyhydroxy fatty acid amide surfactants, or mixtures thereof, according to the formula:

$$R^2—C(O)—N(R^1)—Z,$$

wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilised as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2$—$(CHOR')(CHOH)$—$CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2$—$(CHOH)_4$—$CH_2OH$.

In formula $R^2$—C(O)—N($R^1$)—Z, $R^1$ can be, for example, N-methyl, N-ethyl, N-propyl, N-isopropyl, N-butyl, N-2-hydroxy ethyl, or N-2-hydroxy propyl. $R^2$—C(O)—N< can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants to be used herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Other suitable nonionic surfactants for use herein include amine oxides having the following formula $R_1R_2R_3NO$ wherein each of R1, R2 and R3 is independently a saturated substituted or unsubstituted, linear or branched hydrocarbon chain of from 1 to 30 carbon atoms. Preferred amine oxide surfactants to be used according to the present invention are amine oxides having the following formula $R_1R_2R_3NO$ wherein R1 is an hydrocarbon chain comprising from 1 to 30 carbon atoms, preferably from 6 to 20, more preferably from 8 to 16, most preferably from 8 to 12, and wherein R2 and R3 are independently substituted or unsubstituted, linear or branched hydrocarbon chains comprising from 1 to 4 carbon atoms, preferably from 1 to 3 carbon atoms, and more preferably are methyl groups. R1 may be a saturated substituted or unsubstituted linear or branched hydrocarbon chain. Suitable amine oxides for use herein are for instance natural blend C8–C10 amine oxides as well as C12–C16 amine oxides commercially available from Hoechst.

Another class of surfactants particularly suitable for use herein include zwitterionic betaine surfactants containing both a cationic hydrophilic group, i.e., a quaternary ammonium group, and anionic hydrophilic group on the same molecule at a relatively wide range of pH's. The typical anionic hydrophilic groups are carboxylates and sulfonates, although other groups like sulfates, phosphonates, and the like can be used. A generic formula for the zwitterionic betaine surfactants for use herein is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a$—C(O)—NH—$(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is a $C_1$–$C_4$ carboxylic acid group or C1–C4 sulfonate group, or a $C_1$–$C_3$ alkyl and more preferably methyl. Preferred $R_4$ is $(CH2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N decyl-N, N-dimethylammonia)acetate, 2-(N-coco N,N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or C10–C14 fatty acylamidopropylene(hydropropylene) sulfobetaine. For example C10–C14 fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Mirataine H2C-HA®.

Particularly preferred zwitterionic betaine surfactants for use herein are salt free, i.e. that the zwitterionic betaine surfactant raw material contains less than 5% by weight of salts, preferably less than 2%, more preferably less than 1% and most preferably from 0.01% to 0.5%.

By "salts" is meant herein any material having as base unit, a couple of positive ion (or positive molecular ion) and negative ion (or negative molecular ion) containing one or more halogen atoms. Such salts include Sodium Chloride, Potassium Chloride, Sodium Bromide and the like.

Such salts free zwitterionic betaine surfactants are obtainable by conventional manufacturing processes like inverse osmosis or fractionated precipitation. For example inverse osmosis is based on the principle of contacting the zwitterionic betaine surfactant raw material (commercially available ) with a polar solvent (it is to be understood that such a solvent is free of salts) separated by a semi-permeable membrane for example acetate-cellulose. An adequate pressure is applied on the system to allow the salts to migrate from the surfactant raw material to the polar solvent phase. This way the zwitterionic betaine surfactant raw material is purified, i.e. the salts is subtracted from the raw material.

Advantageously, it has now been surprisingly found that the use of such salt free zwitterionic betaine surfactants deliver improved fabric safety and/or color safety when bleaching fabrics with a peroxygen bleach-containing composition comprising the same, as compared to the use of the same zwitterionic betaine surfactants with higher amount of salts. Thus, in its broadest aspect, the present invention also encompasses the use of a composition comprising a salt free zwitterionic betaine surfactant, a peroxygen bleach and a pH buffering means for bleaching soiled fabrics, especially pretreating soiled fabrics, whereby color safety is improved (i.e. color damage/decoloration is reduced) and/or fabric safety is improved.

In a preferred embodiment, herein the surfactants present in the compositions of the present invention are a mixture of ethoxylated nonionic surfactants and betaine zwitterionic surfactants. Indeed, such betaine zwitterionic surfactants and ethoxylated nonionic surfactants act together to deliver excellent stain removal on greasy stains (e.g., lipstick, olive oil, mayonnaise, vegetable oil, sebum, make-up), while providing improved bleaching performance to the liquid peroxygen bleach-containing compositions of the present invention comprising them.

Indeed, a significant co-operation has been observed between these ingredients to get optimum stain removal performance on a variety of soils, from particulate to non-particulate soils from hydrophobic to hydrophilic soils under any household application and especially laundry application on both hydrophilic and hydrophobic fabrics.

Optimum stain removal performance and bleaching performance are obtained when the ethoxylated nonionic surfactant and the zwitterionic betaine surfactant are present in the compositions of the present invention comprising a peroxygen bleach (pH below 7), at weight ratio of the ethoxylated nonionic surfactant to the zwitterionic betaine surfactant of from 0.01 to 20, preferably from 0.1 to 15, more preferably from 0.5 to 5 and most preferably from 0.6 to 3.

Importantly, the improved stain removal benefit and bleaching benefit are delivered with a liquid composition which is a water-like, clear and transparent composition. The appearance of a composition can be evaluated via turbidimetric analysis. For example, the transparency of a composition can be evaluated by measuring its absorbency via a spectrophotometer at 800 nm wave length.

Although less desirable than the surfactants mentioned above for their stain removal properties, other surfactants may be used in the compositions herein. Suitable anionic surfactants for use in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}E(1.0)M$, $C_{12}$–$C_{18}$ alkyl polyethoxylate (2.25) sulfate, $C_{12}$–$C_{18}E(2.25)M$), $C_{12}$–$C_{18}$ alkyl polyethoxylate (3.0) sulfate, C12–C15 alkyl ethoxylate (3) sulphate, $C_{12}$–$C_{18}$ alkyl polyethoxylate (4.0) sulfate, $C_{12}$–$C_{18}E(4.0)M$, wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants for use herein also include acyl sarcosinate or mixtures thereof, in its acid and/or salt form, preferably long chain acyl sarcosinates having the following formula:

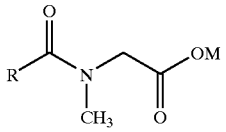

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates for use herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Chelating Agents

Accordingly, the compositions of the present invention may comprise a chelating agent as a preferred optional ingredient. Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

A chelating agent may be desired in the compositions of the present invention as it may contribute to reduce tensile strength loss of fabrics and/or color damage, especially in a laundry pretreatment application. Indeed, the chelating agents inactivate the metal ions present on the surface of the fabrics and/or in the cleaning compositions (neat or diluted) that otherwise would contribute to the radical decomposition of the peroxygen bleach.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents for use herein include salicylic acid, aspartic acid, glutamic acid, glycine, malonic acid or mixtures thereof.

Another chelating agent for use herein is of the formula:

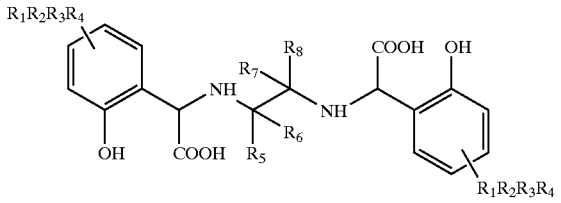

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents for use herein are amino aminotri(methylene phosphonic acid), di-ethylenetriamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention may comprise up to 5% by weight of the total composition of a chelating agent, or a mixture thereof, preferably from 0.01% to 1.5% by weight and more preferably from 0.01% to 0.5%.

Radical Scavengers

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl)butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®. Radical scavengers when used, are typically present herein in amounts ranging from up to 10% by weight of the total composition, preferably from 0.001% to 2% and more preferably from 0.001% to 0.5% by weight.

The presence of radical scavengers may contribute to reduce tensile strength loss of fabrics and/or color damage when the compositions of the present invention are used in any laundry application, especially in a laundry pretreatment application.

Antioxidants

The compositions according to the present invention may further comprise an antioxidant or mixtures thereof. Typically, the compositions herein may comprise up to 10% by weight of the total composition of an antioxidant or mixtures thereof, preferably from 0.002% to 5%, more preferably from 0.005% to 2%, and most preferably from 0.01% to 1%.

Suitable antioxidants for use herein include organic acids like ascorbic acid, adipic acid and sorbic acid, or amines like lecithin, or aminoacias like glutamine, methionine and cysteine, or esters like ascorbil palmitate, ascorbil stearate and triethylcitrate, or mixtures thereof. Preferred antioxidants for use herein are ascorbic acid, ascorbic palmitate, lecithin or mixtures thereof.

Bleach Activators

As an optional ingredient, the compositions of the present invention may comprise a bleach activator or mixtures thereof. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition. The compositions according to the present invention may comprise from 0.01% to 20% by weight of the total composition of said bleach activator, or mixtures thereof, preferably from 1% to 10%, and more preferably from 3% to 7%

The Foam Reducing System

The compositions according to the present invention may comprise a foam reducing agent or a mixture thereof. Any foam reducing agents known to those skilled in the art are suitable for use herein. In a preferred embodiment a foam system comprising a fatty acid together with a capped alkoxylated nonionic surfactant as defined herein after and/or silicone is used.

Typically, the compositions herein may comprise from % to 10% by weight of the total composition of a fatty acid or a mixture thereof, preferably from % to 5% and more preferably from % to 5%.

Typically, the compositions herein may comprise from % to 20% by weight of the total composition of a capped alkoxylated nonionic surfactant as defined herein or a mixture thereof, preferably from % to 10% and more preferably from % to 5%.

Typically, the compositions herein may comprise from % to 5% by weight of the total composition of a silicone or a mixture thereof, preferably from % to 1% and more preferably from % to 0.5%.

Suitable fatty acids for use herein are the alkali salts of a $C_8$–$C_{24}$ fatty acid. Such alkali salts include the metal fully saturated salts like sodium, potassium and/or lithium salts as well as the ammonium and/or alkylammonium salts of fatty acids, preferably the sodium salt. Preferred fatty acids for use herein contain from 8 to 22 carbon atoms, preferably from 8 to 20 and more preferably from 8 to 18.

Suitable fatty acids may be selected from caprylic acid, capric acid, lauric acid, myristic acid, palmitic acid, stearic acid and mixtures of fatty acids suitably hardened, derived from natural sources such as plant or animal esters (e.g., palm oil, coconut oil, soybean oil, castor oil, tallow, ground oil, whale and fish oils and/or babassu oil.

For example Coconut Fatty Acid is commercially available from UNICHEMA under the name PRIFAC 5900®.

Suitable capped alkoxylated nonionic surfactants for use herein are according to the formula:

$$R_1(O—CH_2—CH_2)_n—(OR_2)_m—O—R_3$$

wherein $R_1$ is a $C_8$–$C_{24}$ linear or branched alkyl or alkenyl group, aryl group, alkaryl group, preferably $R_1$ is a $C_8$–$C_{18}$ alkyl or alkenyl group, more preferably a $C_{10}$–$C_{15}$ alkyl or alkenyl group, even more preferably a $C_{10}$–$C_{15}$ alkyl group;

wherein $R_2$ is a $C_1$–$C_{10}$ linear or branched alkyl group, preferably a $C_2$–$C_{10}$ linear or branched alkyl group, preferably a $C_3$ group;

wherein $R_3$ is a $C_1$–$C_{10}$ alkyl or alkenyl group, preferably a $C_1$–$C_5$ alkyl group, more preferably methyl;

and wherein n and m are integers independently ranging in the range of from 1 to 20, preferably from 1 to 10, more preferably from 1 to 5; or mixtures thereof.

These surfactants are commercially available from BASF under the trade name Plurafac®, from HOECHST under the trade name Genapol® or from ICI under the trade name Symperonic®. Preferred capped nonionic alkoxylated surfactants of the above formula are those commercially available under the tradename Genapol® L 2.5 NR from Hoechst, and Plurafac® from BASF.

Suitable silicones for use herein include any silicone and silica-silicone mixtures. Silicones can be generally represented by alkylated polysiloxane materials while silica is normally used in finely divided forms exemplified by silica aerogels and xerogels and hydrophobic silicas of various types. These materials can be incorporated as particulates in which the silicone is advantageously releasably incorporated in a water-soluble or water-dispersible, substantially non-surface-active detergent impermeable carrier.

Alternatively, the silicone can be dissolved or dispersed in a liquid carrier and applied by spraying on to one or more of the other components.

Actually in industrial practice, the term "silicone" has become a generic term which encompasses a variety of relatively high-molecular-weight polymers containing siloxane units a nd hydrocarbyl groups of various types. Indeed, silicone compounds have e been extensively described in the art, see for instance U.S. Pat. Nos. 4,076,648, 4,021,365, 4,749,740, 4,983,316, EP 150 872, EP 217 501 and EP 499 364. The silicone compounds disclosed therein are suitable in the context of the present invention. Generally, the silicone compounds can be described as siloxanes having the general structure:

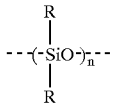

where in n is from 20 to 2000, a nd where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end blocking units and having a viscosity at 25° C. of from $5\times10^{-5}$ $m^2/s$ to 0.1 $m^2/s$, i.e. a value of n in the range 40 to 1500. These are preferred because of their ready availability and their relatively low cost.

A preferred type of silicone compounds useful in the compositions herein comprises a mixture of an alkylated siloxane of the type hereinabove disclosed and solid silica.

The solid silica can be a fumed silica, a precipitated silica or a silica made by the gel formation technique. The silica particles can be rendered hydrophobic by treating them with diakylsilyl groups and/or trialkylsilane groups either bonded directly onto the silica or by means of silicone resin. A preferred silicone compound comprises a hydrophobic silanated, most preferably trimethylsilanated silica having a particle size in the range from 10 mm to 20 mm and a specific surface area above 50 $m^2/g$. Silicone compounds employed in the compositions according to the present invention suitably have an amount of silica in the range of 1 to 30% (more preferably 2.0 to 15%) by weight of the total weight of the silicone compounds resulting in silicone compounds having an average viscosity in the range of from $2\times10^{-4}$ $m^2/s$ to 1 $m^2/s$. Preferred silicone compounds may have a viscosity in the range of from $5\times10^{-3}$ $m^2/s$ to 0.1 $m^2/s$. Particularly suitable are silicone compounds with a viscosity of $2\times10^{-2}$ $m^2/s$ or $4.5\times10^{-2}$ $m^2/s$.

Suitable silicone compounds for use herein are commercially available from various companies including Rhone Poulenc, Fueller and Dow Corning. Examples of silicone compounds for use herein are Silicone DB® 100 and Silicone Emulsion 2-3597® both commercially available from Dow Corning.

Another silicone compound is disclosed in Bartollota et al. U.S. Pat. No. 3,933,672. Other particularly useful silicone compounds are the self-emulsifying silicone compounds, described in German Patent Application DTOS 2 646 126 published Apr. 28, 1977. An example of such a compound is DC-544®, commercially available from Dow Corning, which is a siloxane-glycol copolymer.

Typically preferred silicone compounds are described in European Patent application EP-A-573699. Said compositions can comprise a silicone/silica mixture in combination with fumed nonporous silica such as Aerosil$^R$.

Process of Bleaching Fabrics

In the present invention, the liquid bleaching composition of the present invention needs to be contacted with the fabrics to be bleached. This can be done either in a so-called "pretreatment mode", where the liquid composition is applied neat onto said fabrics before the fabrics are rinsed, or washed then rinsed, or in a "soaking mode" where the liquid composition is first diluted in an aqueous bath and the fabrics are immersed and soaked in the bath, before they are rinsed, or in a "through the wash mode", where the liquid composition is added on top of a wash liquor formed by dissolution or dispersion of a typical laundry detergent.

It is also essential in both cases, that the fabrics be rinsed after they have been contacted with said composition, before said composition has completely dried off.

In the pretreatment mode, the process comprises the steps of applying said liquid composition in its neat form onto said fabrics, or at least soiled portions thereof, and subsequently rinsing, or washing then rinsing said fabrics. In this mode, the neat compositions can optionally be left to act onto said fabrics for a period of time ranging from 1 min. to 1 hour, before the fabrics are rinsed, or washed then rinsed, provided that the composition is not left to dry onto said fabrics. For particularly though stains, it may be appropriate to further rub or brush said fabrics by means of a sponge or a brush, or by rubbing two pieces of fabrics against each other.

In another mode, generally referred to as "soaking", the process comprises the steps of diluting said liquid composition in its neat form in an aqueous bath so as to form a diluted composition. The dilution level of the liquid composition in an aqueous bath is typically up to 1:85, preferably up to 1:50 and more preferably about 1:25 (composition:water). The fabrics are then contacted with the aqueous bath comprising the liquid composition, and the fabrics are finally rinsed, or washed then rinsed. Preferably in that embodiment, the fabrics are immersed in the aqueous bath comprising the liquid composition, and also preferably, the fabrics are left to soak therein for a period of time ranging from 1 minute to 48 hours, preferably from 1 hour to 24 hours.

In yet another mode which can be considered as a sub-embodiment of "soaking", generally referred to as "bleaching through the wash", the liquid composition is used as a so-called laundry additive. And in that embodiment the aqueous bath is formed by dissolving or dispersing a conventional laundry detergent in water. The liquid composition in its neat form is contacted with the aqueous bath, and the fabrics are then contacted with the aqueous bath containing the liquid composition. Finally, the fabrics are rinsed.

Depending on the end-use envisioned, the compositions herein can be packaged in a variety of containers including conventional bottles, bottles equipped with roll-on, sponge, brusher or sprayer.

Although preferred application of the compositions described herein is laundry application and especially laundry pretreatment, the compositions according to the present invention may also be used as a household cleaner in the cleaning of bathroom surfaces or kitchen surfaces.

The invention is further illustrated by the following examples.

EXAMPLES

Following compositions were made by mixing the listed ingredients in the listed proportions (weight % unless otherwise specified).

| Compositions | I | II | III | IV | V | VI | VII | VIII |
|---|---|---|---|---|---|---|---|---|
| Dobanol ® 91-10 | — | — | — | 1.6 | — | — | 2.6 | — |
| Dobanol ® 45-7 | — | 2.0 | 2.6 | — | 2.6 | 1.6 | — | 2.0 |
| Dobanol ® 23-3 | — | — | 1.0 | 2.0 | 1.0 | 2.0 | 1.0 | — |
| Salt-free Betaine* | 5.0 | 2.4 | 2.4 | 2.4 | 2.4 | 5.0 | 2.4 | 5.0 |
| $H_2O_2$ | 7.0 | 6.8 | 5.8 | 7.0 | 5.8 | 7.0 | 5.8 | 7.0 |
| HEDP | 0.16 | — | 0.16 | — | 0.16 | 0.16 | 0.16 | 0.16 |
| DTPMP | — | 0.18 | — | 0.18 | — | — | — | — |
| Propyl gallate | 0.1 | 0.1 | — | — | — | 0.1 | — | 0.1 |
| BHT | — | — | 0.1 | 0.1 | 0.1 | — | 0.1 | — |

-continued

| Compositions | I | II | III | IV | V | VI | VII | VIII |
|---|---|---|---|---|---|---|---|---|
| Citric acid | 0.30 | 0.5 | 0.50 | 0.3 | 0.50 | 0.50 | 0.50 | 0.50 |
| Perfume* | 0.10 | 0.20 | 0.15 | 0.05 | 0.16 | 0.15 | 0.16 | 0.10 |
| Fatty Acid | 0.10 | 0.10 | 0.25 | 0.10 | 0.175 | 0.25 | 0.175 | 0.10 |
| Capped alcohol* | 0.10 | — | 0.10 | 2.0 | 0.10 | — | 0.10 | 0.10 |
| Silicone DB ® 100 | — | 0.004 | 0.002 | — | 0.002 | 0.004 | 0.002 | 0.004 |
| Water and minors | | | | up to 100% | | | | |
| NaOH or KOH up to pH 4 or 5 | | | | | | | | |

| Compositions | IX | X | XI | XII | XIII | XIV | XV |
|---|---|---|---|---|---|---|---|
| Dobanol ® 91-10 | — | — | 1.6 | — | — | 1.6 | — |
| Dobanol ® 45-7 | 1.6 | 1.6 | — | — | 1.6 | — | 2.0 |
| Dobanol ® 23-3 | 1.5 | 1.5 | 2.0 | 2.0 | 2.0 | 2.0 | 2.0 |
| Glucose Amide* | 1.5 | 1.5 | 1.5 | 1.5 | 1.5 | 1.5 | 1.5 |
| C25-AE3-S | 2.0 | 2.0 | 2.0 | 2.0 | 2.0 | 3.0 | 1.0 |
| Fatty Acid | 0.10 | 0.10 | 0.10 | 0.10 | 0.25 | 0.25 | — |
| Capped alcohol* | 0.10 | 0.10 | — | 2.0 | — | 0.25 | — |
| Silicone DB ® 100 | — | 0.004 | 0.004 | — | 0.004 | 0.004 | — |
| $H_2O_2$ | 7.0 | 6.0 | 7.0 | 6.0 | 7.0 | 6.0 | 7.0 |
| HEDP | — | 0.16 | 0.16 | — | 0.16 | 0.16 | — |
| DTPMP | 0.18 | — | — | 0.18 | — | — | — |
| Propyl gallate | 0.1 | 0.1 | 0.1 | 0.3 | 0.1 | 0.1 | — |
| Citric acid/ sodium citrate | 0.50 | 0.40 | 0.35 | 0.75 | — | — | — |
| Tartaric acid/ potassium hydrogen tartarate | — | — | — | — | 0.50 | 0.25 | 0.75 |
| Perfume* | 0.15 | 0.16 | 0.15 | 0.16 | 0.15 | 0.16 | 0.10 |
| Water and minors | | | | up to 100% | | | |
| pH (neat product) | 5 | 5 | 5 | 5 | 4 | 4 | 4 |

| Compositions (% weight) | XVI | XVII | XVIII | XIX | XX | XXI | XXII | XXIII |
|---|---|---|---|---|---|---|---|---|
| Dobanol ® 91-10 | — | 1.6 | — | — | — | — | 1.6 | — |
| Dobanol ® 45-7 | 1.6 | — | 2.6 | 1.6 | 2.0 | 1.6 | — | — |
| Dobanol ® 23-3 | 1.5 | 2.0 | 1.0 | 2.0 | 2.0 | 2.0 | 2.0 | — |
| Glucose amide* | 1.5 | 1.5 | — | 1.5 | 1.5 | — | — | — |
| C25-AE3-S | 2.0 | 2.0 | — | 2.0 | 1.0 | — | — | — |
| Lauryl Betaine | — | — | 2.4 | — | — | 5.0 | 5.0 | — |
| $H_2O_2$ | 6.0 | 7.0 | 6.0 | 7.0 | 7.0 | 7.0 | 7.0 | 7.0 |
| HEDP | 0.16 | 0.16 | 0.16 | 0.16 | — | 0.16 | 0.16 | — |
| DTPMP | — | — | — | — | 0.18 | — | — | — |
| BHT | 0.1 | 0.1 | 0.1 | 0.1 | 0.3 | 0.1 | 0.1 | — |
| Citric acid/citrate | 0.50 | 0.25 | 0.75 | 1.0 | — | — | 0.5 | 0.5 |
| oxalic acid/sodium oxalate | — | — | — | — | 0.50 | 0.75 | 0.5 | — |
| Perfume* | 0.1 | 0.15 | 0.1 | 0.15 | 0.1 | 0.15 | 0.1 | 0.10 |
| Water and minors | | | | up to 100% | | | | |

-continued

| Compositions (% weight) | XVI | XVII | XVIII | XIX | XX | XXI | XXII | XXIII |
|---|---|---|---|---|---|---|---|---|
| pH (neat product) | 5 4.5 | 5 | 5 | 5 | 4 | 4 | 4 | |

HEDP is 1-hydroxy-ethane diphosphonate.

DTPMP is diethylene triamine penta methylene phosphonate.

BHT is di-tert-butyl hydroxy toluene

Salt-free Betaine* is Lauryl di-methyl betaine containing 0.3% by weight of sodium chloride. This betaine is obtainable by purification from commercially available Lauryl di-methyl betaine GENAGEN LAB® (Hoechst) (which contains 7.5% of sodium chloride).

The perfume used in the compositions above contains as main ingredients di-hydro-myrcenol and hexyl cinnamic aldehyde.

Compositions I to XXIII when used to bleach soiled coloured fabrics exhibit excellent color safety as well as good fabric safety to the fabrics bleached therewith.

For example in a pretreatment mode, compositions I to XXIII are applied neat on the stained portion of a fabric and left to act thereon for 5 minutes. Then the fabric is washed with a conventional detergent and rinsed. Surprisingly, excellent colour safety as well as good fabric safety is obtained with these compositions, this even when leaving these compositions to act onto the fabrics for prolonged time, e.g. 1 hour, before washing the fabrics.

In a bleaching-through-the-wash mode, any of the compositions I to XXIII is contacted with an aqueous bath formed by dissolution of a conventional detergent in water. Fabrics are then contacted with the aqueous bath comprising the liquid detergent, and the fabrics are rinsed. They can also be used in a soaking mode, where 100 ml of the liquid compositions are diluted in 10 liters of water. The fabrics are then contacted with this aqueous bath containing the composition, and left to soak therein for a period of time of 24 hours. The fabrics are eventually rinsed.

What is claimed is:

1. A liquid composition having a pH up to 7 and comprising a peroxygen bleach, from 0.1% to 10% by weight of the total composition of a weak acid and conjugate base pH buffering means, and from 0.0001% to 5% by weight of a perfume.

2. A composition according to claim 1 wherein said peroxygen bleach is hydrogen peroxide or a water soluble source thereof, selected from the group consisting of percarbonates, persilicates, perborates, peroxyacids, hydroperoxides, aromatic and aliphatic diacyl peroxides and mixtures thereof.

3. A composition according to claim 1 which comprises from about 0.1% to about 20% by weight of the total composition of said peroxygen bleach or a mixture thereof.

4. A composition according to claim 3 which comprises from about 1% to about 15% by weight of the total composition of said peroxygen bleach or a mixture thereof.

5. A composition according to claim 3 which comprises from about 2% to about 10% by weight of the total composition of said peroxygen bleach or a mixture thereof.

6. A composition according to claim 1 wherein said pH buffering means comprises a weak acid having its pKa or one of its pKa of from about 1.5 to about 6.5, and its conjugated base.

7. A composition according to claim 6 wherein said pH buffering means comprises a weak acid having its pKa or one of its pKa of from about 2 to about 6, and its conjugated base.

8. A composition according to claim 6 wherein said pH buffering means comprises a weak acid having its pKa or one of its pKa of from about 4 to about 6, and its conjugated base.

9. A composition according to claim 1 wherein said pH buffering means is citric acid/sodium citrate, citric acid/potassium citrate, oxalic acid/sodium oxalate, tartaric acid/potassium hydrogen tartarate, oxalic acid/potassium tetra oxalate dihydrate, phtalic acid/potassium phtalate, acetic acid/sodium acetate, formic acid/sodium formate, benzoic acid/sodium benzoate, and/or salicylic acid/sodium salicylate.

10. A composition according to claim 1 which comprises from about 0.2% to about 8% by weight of the total composition of a pH buffering means or a mixture thereof.

11. A composition according to claim 10 which comprises from about 0.3% to about 5% by weight of the total composition of a pH buffering means or a mixture thereof.

12. A composition according to claim 10 which comprises from about 0.3% to about 3% by weight of the total composition of a pH buffering means or a mixture thereof.

13. A composition according to claim 10 which comprises from about 0.3% to about 2% by weight of the total composition of a pH buffering means or a mixture thereof.

14. A composition according to claim 1 which comprises from about 0.0001% to about 1% by weight of the total composition of a perfume or a mixture thereof.

15. A composition according to claim 14 which comprises from about 0.001% to about 1% by weight of the total composition of a perfume or a mixture thereof.

16. A composition according to claim 14 which comprises from about 0.01% to about 0.5% by weight of the total composition of a perfume or a mixture thereof.

17. A composition according to claim 1 wherein said composition comprises up to about 60% by weight of the total composition of a surfactant or mixture thereof.

18. A composition according to claim 17 wherein said composition comprises from about 0.1% to about 30% by weight of the total composition of a surfactant or mixture thereof.

19. A composition according to claim 17 wherein said composition comprises from about 0.5% to about 15% by weight of the total composition of a surfactant or mixture thereof.

20. A composition according to claim 17 wherein said surfactant is a nonionic surfactant and/or a zwitterionic surfactant.

21. A composition according to claim 20 wherein said nonionic surfactant is an ethoxylated nonionic surfactant according to the formula $RO—(C_2H_4O)_nH$, wherein R is a $C_6$ to $C_{22}$ alkyl chain or a $C_6$ to $C_{28}$ alkyl benzene chain, and wherein n is an integer from about 0 to about 20, and/or an amine oxide surfactant, and/or a polyhydroxy fatty acid amide surfactant.

22. A composition according to claim 21 wherein said zwitterionic surfactant is a zwitterionic betaine surfactant having the formula:

$$R_1—N^+(R_2)(R_3)R_4X—$$

wherein $R_1$ is an aliphatic or aromatic, saturated or unsaturated, substituted or unsubstituted hydrocarbon chain that can contain linking groups, or an amido radical of the formula $R_a—C(O)—NH—(C(R_b)_2)_m$, wherein $R_a$ is an aliphatic or aromatic, saturated or unsaturated, substituted or unsubstituted hydrocarbon chain, with no more than one hydroxy group in any $(C(R_b)_2)$ moiety; $R_2$ is hydrogen, $C_1$–$C_6$ alkyl, hydroxy alkyl or other substituted $C_1$–$C_6$ group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group; and X is a carboxylate or sulfonate group; or a mixture thereof.

23. A composition according to claim 22, wherein said zwitterionic betaine surfactant is a salt free zwitterionic betaine surfactant containing less than about 5% by weight of salts.

24. A composition according to claim 23, wherein said salt free zwitterionic betaine surfactant contains less than about 3% by weight of salts.

25. A composition according to claim 23, wherein said salt free zwitterionic betaine surfactant contains less than about 2% by weight of salts.

26. A composition according to claim 23, wherein salt free zwifterionic betaine surfactant contains less than about 1% by weight of salts.

27. A composition according to claim 23, wherein salt free zwitterionic betaine surfactant contains from about 0.01% to about 0.5% by weight of salts.

28. A composition according to claim 1 wherein said composition further comprises a chelating agent or a mixture thereof, said chelating agent or mixture thereof comprising up to about 5% by weight of the total composition.

29. A composition according to claim 1 wherein said composition is aqueous and has a pH from about 1 to about 6.

30. A composition according to claim 29 wherein said composition is aqueous and has a pH from about 1.5 to about 5.5.

31. A process of bleaching fabrics which includes the steps of diluting in an aqueous bath a liquid composition according to claim 1 in its neat form, contacting said fabrics with said aqueous bath comprising said liquid composition, and subsequently rinsing, or washing then rinsing said fabrics.

32. A process of bleaching fabrics which includes the steps of diluting in an aqueous bath a liquid composition according to claim 22 in its neat form, contacting said fabrics with said aqueous bath comprising said liquid composition, and subsequently rinsing, or washing then rinsing said fabrics.

33. A process of bleaching fabrics which includes the steps of diluting in an aqueous bath a liquid composition according to claim 23 in its neat form, contacting said fabrics with said aqueous bath comprising said liquid composition, and subsequently rinsing, or washing then rinsing said fabrics.

34. A process of pretreating fabrics which comprises the steps of applying a liquid composition according to claim 1 in its neat form, onto said fabrics or only onto the soiled portion of said fabrics, before rinsing said fabrics or washing then rinsing said fabrics.

35. A process of pretreating fabrics which comprises the steps of applying a liquid composition according to claim 22 in its neat form, onto said fabrics or only onto the soiled portion of said fabrics, before rinsing said fabrics or washing then rinsing said fabrics.

36. A process of pretreating fabrics which comprises the steps of applying a liquid composition according to claim 23 in its neat form, onto said fabrics or only onto the soiled portion of said fabrics, before rinsing said fabrics or washing then rinsing said fabrics.

37. A process according to claim 31, wherein the fabrics are left to soak in said aqueous bath comprising said liquid composition for a period of time ranging from about 1 minute to about 48 hours.

38. A process according to claim 32, wherein the fabrics are left to soak in said aqueous bath comprising said liquid composition for a period of time ranging from about 1 minute to about 48 hours.

39. A process according to claim 33, wherein the fabrics are left to soak in said aqueous bath comprising said liquid composition for a period of time ranging from about 1 minute to about 48 hours.

40. A process according to claim 31, wherein said aqueous bath is formed by dissolving or dispersing a conventional laundry detergent in water.

41. A composition according to claim 9 wherein said buffering means is selected from the group consisting of citric acid/sodium citrate, citric acid/potassium citrate and mixtures thereof.

* * * * *